US011304542B2

(12) United States Patent
Goppion et al.

(10) Patent No.: US 11,304,542 B2
(45) Date of Patent: Apr. 19, 2022

(54) MUSEUM DISPLAY CASE WITH IMPROVED RELATIVE HUMIDITY CONTROL AND RELATED CONTROL METHOD

(71) Applicant: GOPPION S.P.A., Trezzano Sul Naviglio (IT)

(72) Inventors: Alessandro Goppion, Milan (IT); Sergio Matteo Savaresi, Cremona (IT); Silvia Carla Strada, Milan (IT); Mara Tanelli, Lodi (IT)

(73) Assignee: GOPPION S.P.A., Trezzano sul Naviglio (IT)

( * ) Notice: Subject to any disclaimer, the term of this patent is extended or adjusted under 35 U.S.C. 154(b) by 34 days.

(21) Appl. No.: 16/701,068

(22) Filed: Dec. 2, 2019

(65) Prior Publication Data

US 2020/0170422 A1 Jun. 4, 2020

(30) Foreign Application Priority Data

Dec. 3, 2018 (IT) ..... 102018000010764

(51) Int. Cl.
*A47F 3/00* (2006.01)

(52) U.S. Cl.
CPC ..... *A47F 3/001* (2013.01)

(58) Field of Classification Search
CPC ..... A47F 3/001
See application file for complete search history.

(56) References Cited

U.S. PATENT DOCUMENTS 4,711,294 A * 12/1987 Jacobs ..... F24F 3/153 165/230
5,687,576 A 11/1997 Moriguchi et al.
2005/0061758 A1* 3/2005 Nomura ..... F25D 25/02 211/85.4

FOREIGN PATENT DOCUMENTS

EP 2801299 A1 11/2014
GB 2555930 A 5/2018
JP 2000205739 A 7/2000

OTHER PUBLICATIONS

Search Report and Written Opinion for Italian Application No. 102018000010764 filed on Dec. 3, 2018 on behalf of GOPPION S.p.A. Date of Completion of Report: May 14, 2019. 9 Pages.

* cited by examiner

*Primary Examiner* — Thomas M Sember
(74) *Attorney, Agent, or Firm* — Steinfl + Bruno LLP

(57) ABSTRACT

A display case for preserving and displaying objects in a protected environment. The display case includes: a display space, delimited by separating walls including a lower plane, side walls and a ceiling; and means for adjusting and controlling air climate in the display space. The means for adjusting and controlling include: a hygrometric probe for detecting the relative humidity inside the display space: a control unit, connected to the hygrometric probe and a first relative humidity control electrolytic membrane, located in a first opening formed in one of the separating walls, activated by the control unit.

6 Claims, 2 Drawing Sheets

MUSEUM DISPLAY CASE WITH IMPROVED RELATIVE HUMIDITY CONTROL AND RELATED CONTROL METHOD

CROSS REFERENCE TO RELATED APPLICATIONS

The present application claims priority to Italian patent application no. 102018000010764 filed on Dec. 3, 2018, the contents of which are incorporated herein by reference in their entirety.

FIELD

The present invention relates to a museum display case, i.e. a display case for preserving and displaying objects in a protected environment, such as typically artworks, objects of cultural heritage or in any case delicate objects, in museums, exhibitions and the like. The invention also relates to a method for preserving and displaying objects in a protected environment.

BACKGROUND

Protected environment means herein and below an environment in which the atmosphere is controlled, by monitoring one or more parameters among temperature, relative humidity, dust content, and pollutant content, in order to maintain the required preservation conditions of the displayed objects, and in which the possibility of access to unauthorized personnel is prevented, to avoid theft or damage to the displayed objects. In display cases of this type, therefore, both the sealing of all the openable parts (such as doors for accessing the display space or drawers for housing hygroscopic material) must be guaranteed, in order to avoid uncontrolled introduction of external air, and the air exchange suitable for the displayed objects, with treated air so as to have the provided characteristics (relative humidity, temperature, cleaning).

Furthermore, of course, these display cases must guarantee the best visibility for the objects on display so as to allow those who manage museums and exhibitions to organize adequate exhibition itineraries, depending on the cultural message they want to convey.

Especially when the objects to be displayed are very delicate, the climatic conditions must be controlled very carefully and precisely, to avoid damage to the objects.

Those who manage museums and exhibitions of delicate objects, which require pre-established climatic conditions, therefore feel the need for innovative tools that allow them greater freedom in the arrangement of these objects in the exhibition itineraries, with the most scrupulous respect for the ideal preservation climatic conditions.

EP 2801299 A1 describes a display case in which different climatic zones are obtained in the same display space without there being dividing walls, thanks to suitable flows of differently conditioned air. However, this solution can be difficult to implement in practice, especially when it is necessary to prevent the air in the display case from moving too fast, for example because the objects to be displayed are so delicate that they can be damaged due to the dynamic action of the air itself; even the bulk of a display case of this type can be problematic.

SUMMARY

The present disclosure relates, in a first aspect, to a display case and in a second aspect to a method according to what shown in the independent claims. Preferred features of the display case and of the method are indicated in the dependent claims.

More particularly, a display case according to the present disclosure comprises

- a display space, delimited by separating walls comprising a lower plane, side walls and a ceiling,
- means for adjusting and controlling air climate in the display space, comprising:
  - a hygrometric probe for detecting the relative humidity inside the display space,
  - a control unit, connected to the hygrometric probe, wherein the adjusting and control means further comprise:

- a first relative humidity control electrolytic membrane, located in a first opening formed in one of the separating walls, activated by the control unit.

An electrolytic membrane is a device known per se (as for example described in U.S. Pat. No. 5,687,576) which allows—when activated—reducing the relative humidity near one of its two sides (which can therefore be called dry side) and simultaneously increase it at the opposite side (humid side). More precisely, when a suitable electrical voltage is applied to the membrane, on the dry side thereof the water molecules are dissociated into hydrogen ions and oxygen ions; the hydrogen ions then migrate through the membrane, until they reach the humid side where they react with the oxygen present in the air beyond the membrane, forming water molecules. The use of these membranes for reducing the relative humidity in closed environments, and for example containers, is known, without it being necessary to provide for the collection and disposal of water: in fact, the reduction in relative humidity that occurs at the dry side of the membrane, inwardly oriented of the container, does not derive from a separation of water vapour from the air, but from a transfer of water vapour, from the internal air that is located near the dry side of the membrane to the external air that is near the humid side. In the following, sometimes only the term membrane will be used, meaning an electrolytic membrane.

This feature of the operation is particularly advantageous in a display case, where the disposal of condensate could be difficult or at least annoying. The main advantage is however that of being able to adjust the relative humidity of the display case in a much more precise way than is possible with the techniques available in the art and with much less sensitivity with respect to the external climatic conditions.

A membrane of the aforesaid type can therefore be in two states: activated, in which—as said—the membrane transfers an environmental humidity from the dry side to the humid side, and deactivated (or not activated), in which the membrane is substantially inert.

Preferably, the adjusting and control means comprise a second relative humidity control electrolytic membrane, located in a second opening formed in one of the separating walls and activated by the control unit, wherein the first electrolytic membrane is mounted in the first opening with a dry side thereof inwardly oriented in the display space while the second electrolytic membrane is mounted in the second opening with a humid side inwardly oriented in the display space.

The use of a pair of two electrolytic membranes for controlling relative humidity mounted in an opposite way with respect to one another allows the relative humidity conditions inside the display case to be adjusted very precisely and quickly; in fact, if the relative humidity in the display case should become too low, the simple interruption of the activation of the membrane with the dry side towards the window could allow raising the relative humidity in the display case, but generally in a rather long time and in any case not controllable, as it depends on the environmental conditions.

Preferably, the two membranes of the pair are alternately activated by the control unit, for time intervals determined on the basis of the relative humidity values detected by the hygrometric probe. In other words, at any time one of the two membranes is activated while the other is deactivated; there are no moments in which both are activated or both deactivated. The relative humidity adjustment in the display case is therefore achieved in a very precise manner by determining the duration of the time intervals in which each of the membranes is active. In other embodiments, however, different modes can be provided for, in which at certain instants the two membranes are in the same state, activated or deactivated.

If necessary, for example for large display cases or for very critical environmental conditions, more membranes or pairs of membranes may be provided, arranged and controlled in the aforesaid manner. If more than one pair of membranes are used, each pair can clearly have the characteristics indicated herein.

Preferably, each of the two openings is provided with a shutter, movable between a closed position wherein it closes the opening when the electrolytic membrane in such opening is not activated and an open position wherein it leaves the opening open when the electrolytic membrane in such opening is activated. In this way, the membrane which is not activated is also mechanically blocked, so as to exclude as far as possible a transfer of humidity through the non-activated membrane.

Preferably, the two openings are placed adjacent to each other and the shutter is only one for the two openings and is movable between the two positions, each of which is a closed position for one of the two openings and simultaneously an open position for the other of the two openings. Since there is always a deactivated and an activated membrane, a single adequately mounted shutter can be sufficient.

Preferably, the first opening and/or second opening are formed on the side walls of the display case. These walls are in fact vertical or substantially vertical and this positioning puts the electrolytic membranes in a condition of best operation, i.e. to transfer a greater quantity of humidity, other conditions being equal.

In a preferred embodiment, the display case comprises at least two climatic zones within the display space, having pre-established relative humidity conditions different one from the other, more in particular a general climatic zone and one or several particular climatic zones, the display case comprising at least one electrolytic membrane of relative humidity control and a hygrometric probe at each particular climatic zone.

Thanks to the action of reducing the relative humidity of the air in the area of the dry side of the membrane, it is possible to create near the dry side a climatic zone with reduced relative humidity with respect to another climatic zone farther from the dry side, even in the absence of separating walls between the two climatic zones.

Thanks to these features, the display case is suitable to accommodate different objects that require different climatic conditions in a single display space. Consequently, the arrangement of objects in the museum space is no longer conditioned by the need to correctly preserve the single objects to be displayed, but can be defined on the basis of cultural criteria of sequence and juxtaposition between various objects, while respecting the different preservation needs of the objects. It is therefore possible to avoid having to group together objects with the same climatic needs in the same display cases, even when the logical arrangement for a better enjoyment by the public would be different, as well as having to use display cases for single objects, thus leading to an increase in the number of display cases that cause not only high costs but also a fragmentation of the exhibition that can harm the cultural message.

In practice, in this way, with the usual air conditioning systems, pre-established conditions can be set for a general climatic zone; with relative humidity control electrolytic membranes, particular climatic zones are then created near the membranes, where the relative humidity is different from that in the general climatic zone. In each particular climatic zone, the relative humidity can be adjusted independently, by acting on the membranes. In this way it is achieved that each climatic zone has the desired relative humidity conditions (required for example by different objects displayed in the same display space), although it is not separated from the general climatic zone and from any other particular climatic zones by means of insulating walls.

In a preferred embodiment, said at least two climatic zones comprise two or more particular climatic zones, the display case comprising a humidity control electrolytic membrane (or a pair of membranes) at each particular climatic zone.

The control unit can be only one, for all the membranes of all the climatic zones, or it can include a control unit for each of the particular climatic zones.

A method according to the present disclosure provides for detecting and adjusting the relative humidity inside the display space, providing at least a first humidity control electrolytic membrane, facing the display space, and activating and deactivating the first electrolytic membrane as a function of the relative humidity detected inside the display space.

As already mentioned above, the use of an electrolytic membrane allows a precise and effective adjustment of the relative humidity in the display case.

Preferably, the method further envisages providing one second relative humidity control electrolytic membrane, facing the display space opposite-oriented with respect to the first relative humidity control electrolytic membrane, and for activating and deactivating the first and the second electrolytic membrane according to the relative humidity detected inside the display space.

Preferably, the method also provides for closing by means of a shutter each of the first and the second electrolytic membrane when this is deactivated.

BRIEF DESCRIPTION OF THE DRAWINGS

Further characteristics and advantages of a display case according to the present disclosure will be more evident from the following description of a preferred embodiment thereof, made with reference to the appended drawings. In such drawings.

Figure 1:
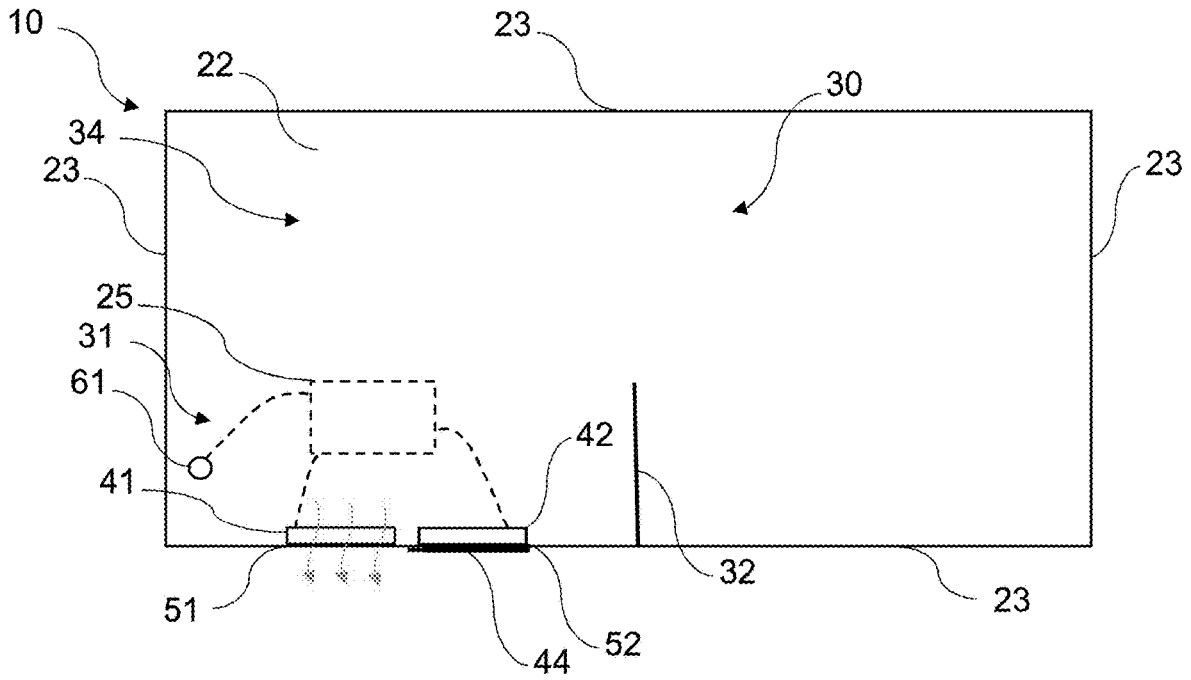
FIG. 1 is a schematic plan view of a display case according to the present disclosure, in a first operating condition.

DETAILED DESCRIPTION in FIG. 1, a display case according to the present disclosure is generally indicated with 10. The display case 10 comprises a base surmounted by a case; the case is formed by separating walls that isolate an internal display space 30 from the external environment. The separating walls comprise in particular a lower plane 22, side walls 23 and a ceiling (not visible in the figures). The separating walls are coupled together by sealing and at least one of them (typically a side wall) can be opened in a per se conventional manner; in the figures, neither the openable walls nor the sealing means are highlighted, since they are extraneous to the invention; moreover, at least some of the side walls 23 and possibly the ceiling are at least partly made of transparent material, typically glass.

The display case 10 comprises a particular climatic zone 31 in the display space 30. The climatic zone 31 is defined by specific differentiated (or differentiable) climatic conditions; the climatic zone 31 is partially separated from the rest of the display space 30 by means of a septum 32 which however does not isolate the climatic zone 31.

The display case 10 also comprises means for adjusting and controlling the air in the display space 30. These adjusting and control means comprise relative humidity control electrolytic membranes 41, 42, in the particular climatic zone 31 which membranes are mounted in respective openings 51, 52 formed in one of the separating walls of the case 21, in particular in one of the side walls 23, so as to be facing the display space 30.

The display case 10 further comprises, in the particular climatic zone 31, a hygrometric probe 61, capable of measuring the relative humidity in the same particular climatic zone 31. A control unit 25 is connected to the membranes 41, 42 and to the probe 61, to receive signals and process and transmit commands.

The control unit 25 is set to feed each of the membranes 41, 42 so that in the climatic zone 31 the desired relative humidity conditions are established; the hygrometric probe 61 allows a feedback control, so as to obtain an accurate adjustment of the relative humidity conditions in the climatic zone 31, The membranes of a same climatic zone are clearly all fed in the same way, independently of how the membranes of the other climatic zones are fed.

Figure 2:
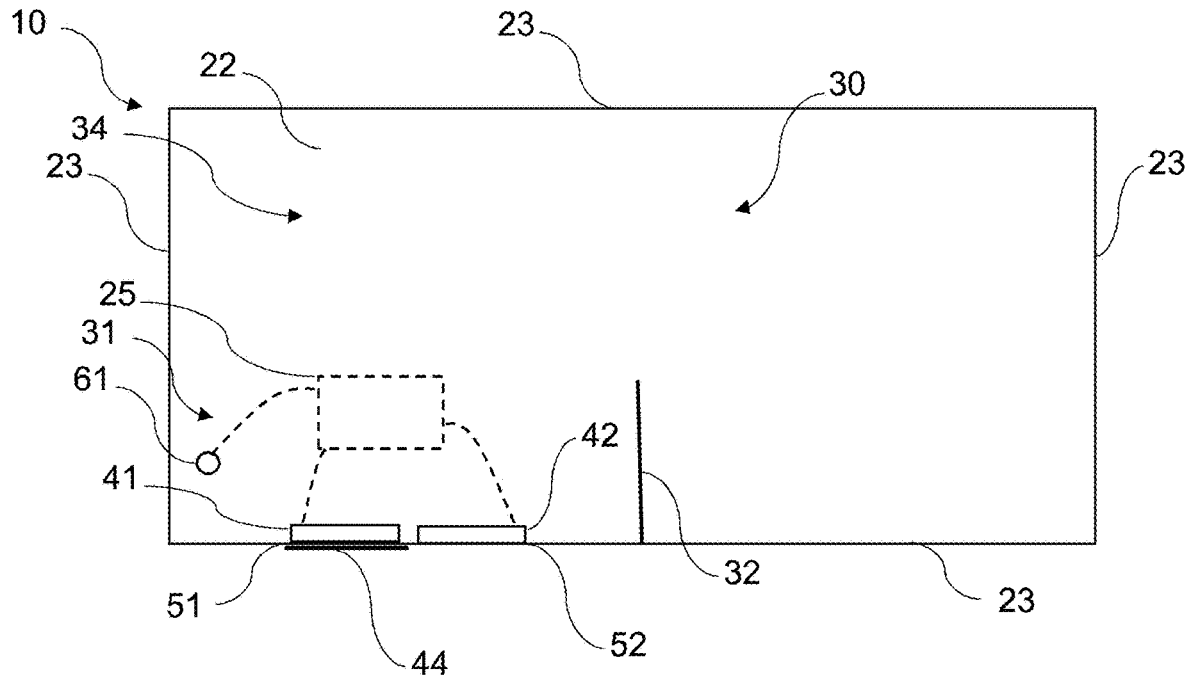
FIG. 2 is a schematic plan view of a display of FIG. 1 case according to the invention; in a second operating condition.

The membranes 41, 42 are mounted in an opposite way: the membrane 41 is mounted with its dry side oriented towards the display space 30 inside the display case 10 and its humid side is oriented outwardly of the display case 10, while vice versa the membrane 42 is mounted with its humid side oriented towards the display space 30 inside the display case 10 and its dry side oriented outwardly of the display case 10. Therefore, as shown graphically schematically by the arrows in FIGS. 1 and 2, the membrane 41 is able—when activated—to subtract humidity from the inside of the display space 30, while the membrane 42 is able—when activated—to increase the humidity inside the display space 30.

The operating unit 25 operates so as to alternately activate the membrane 41 or the membrane 42, based on the relative humidity value measured by the probe 61.

In the display case 10, no general air conditioning system is shown; however, it is possible that the display case is also provided with such a conventional system, in order to set average climatic conditions, which are then changed locally (as regards relative humidity) in the particular climatic zone 31 by means of the membranes 41, 42.

In use, the membranes 41, 42 exert an influence in the climatic zone 31, in the sense of increasing or decreasing the relative humidity therein, depending on how they are controlled by the control unit 25. The influence extends starting from the membranes 41, 42 and is clearly attenuated as the distance from the membranes 41, 42 increases, but—with a suitable sizing—it is sufficient to ensure the climatic zone 31 to have an extension suitable for the correct housing of objects to be displayed in the display case 10. At a certain distance with respect to the membranes 41, 42 it is possible that the membranes does not exert any influence, and that therefore a general climatic zone 34 remains, different from the particular climatic zone 31 and not provided with relative humidity control electrolytic membrane. The climatic conditions and in particular the relative humidity of the general climatic zone 34 are caused by the environmental conditions, by the possible general air-conditioning system (which might also be of a conventional, active and/or passive type) of the display case, as well as—to a certain extent—even by the influence of the particular climatic zone 31. However, it is possible to size and arrange the membranes 41, 42 so that there is no general climatic zone, since the climatic zone 31 extends throughout the display space 30.

In the display case 10, the two openings 51, 52 are placed adjacent to each other and the shutter 44 is envisaged on the two openings 51, 52 so as to be movable—with respect to each of the openings 51, 52—between a closed position wherein it closes the opening 51, 52 when the electrolytic membrane 41, 42 in such opening is not activated and an open position wherein it leaves the opening 51, 52 open when the electrolytic membrane 41, 42 in such opening is activated. The shutter 44 is only one for the two openings 51, 52 and is therefore movable between two positions, each of which is a closed position for one of the two openings and simultaneously an open position for the other of the two openings. In a variant, not shown, two distinct shutters could be provided, one for each of the openings 51, 52.

Figure 3:
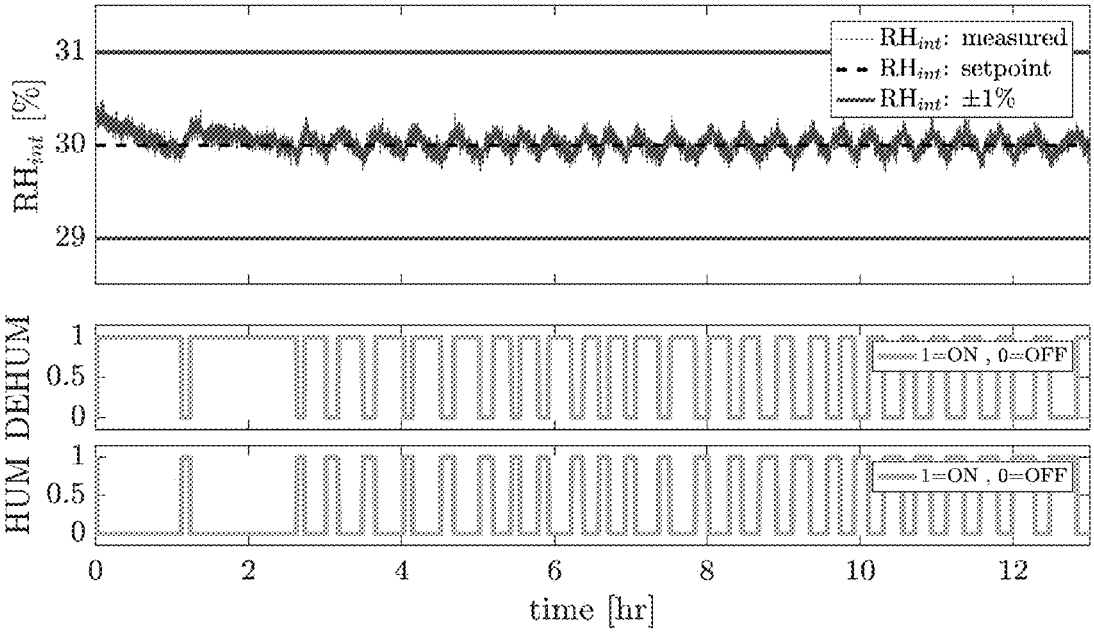
FIG. 3 is a diagram illustrating the operation of the display case according to the invention.

FIG. 3 shows in a graph the operation of the display case 10. To obtain this graph, a display case 10 has been prepared with an internal volume of 1 $m^3$, without any septum 32 inside the display space 30, arranged in a laboratory under environmental conditions of temperature equal to about 20-23° C. and relative humidity equal to around 22-25%; the control unit was set to obtain a relative humidity (HR) value of 30% in the display space 30.

FIG. 3 shows the time on the abscissa, while the states of activation and non-activation of the two membranes 41 and 42 are represented on the ordinate as well as the relative humidity value detected by the probe 61. It is clear that thanks to several embodiments of the present disclosure it is possible to guarantee an almost perfect maintenance of the set relative humidity value, with variations well below 1% of relative humidity value.

Of course, many variants are possible, for example, to provide for several particular climatic zones, variously arranged in the display space.

The invention claimed is:

1. A display case for preserving and displaying objects in a protected environment, comprising a display space, delimited by separating walls comprising a lower plane and side walls, and means for adjusting and controlling air climate in the display space, comprising:

a hygrometric probe for detecting the relative humidity inside the display space, a control unit connected to the hygrometric probe, and a first relative humidity control electrolytic membrane, located in one first opening formed in one of the separating walls, activated by the control unit;

wherein:

the means for adjusting and controlling further comprises a second relative humidity control electrolytic membrane located in a second opening formed in one of the separating walls and activated by the control unit, the first electrolytic membrane is mounted in the first opening with a dry side thereof inwardly oriented in the display space while the second electrolytic membrane is mounted in the second opening with a humid side inwardly oriented in the display space, the first electrolytic membrane and the second electrolytic membrane are alternatively activated by the control unit for determined time ranges based on relative humidity values detected by the hygrometric probe, and each of the two openings is provided with a shutter movable between a closed position wherein the shutter closes the opening when the electrolytic membrane in such opening is not activated and an open position wherein the shutter leaves the opening open when the electrolytic membrane in such opening is activated.

2. The display case according to claim 1, wherein the two openings are placed adjacent to each other and the shutter is only one for the two openings and is movable between the two positions, each of which is a closed position for one of the two openings and simultaneously an open position for the other of the two openings.

3. The display case according to claim 1, wherein the first opening and the second opening are formed on the side walls of the display case.

4. The display case according to claim 1, comprising at least two climatic zones within the display space having set relative humidity conditions different from each other.

5. The display case according to claim 4, wherein said at least two climatic zones comprise a general climatic zone and one or several particular climatic zones, the display case comprising at least one electrolytic membrane of relative humidity control and a hygrometric probe at each particular climatic zone.

6. A method for preserving and displaying objects in a display space, comprising detecting relative humidity inside the display space, and adjusting the relative humidity inside the display space by providing at least one first relative humidity control electrolytic membrane, facing the display space, activating and deactivating the first electrolytic membrane according to the relative humidity detected inside the display space, providing a second relative humidity control electrolytic membrane facing the display space opposite-oriented with respect to the first relative humidity control electrolytic membrane, activating and deactivating the first and the second electrolytic membrane according to the relative humidity detected inside the display space, and closing by a shutter each of the first and the second electrolytic membrane when deactivated.

* * * * *